US011495152B2

(12) United States Patent
Kissel et al.

(10) Patent No.: US 11,495,152 B2
(45) Date of Patent: Nov. 8, 2022

(54) METHOD FOR DIAGNOSING DISPLAY CONNECTION AND OPERATION

(71) Applicant: Kostal of America, Inc., Troy, MI (US)

(72) Inventors: Paul W. Kissel, Waterford, MI (US); Xiaozhong Duan, Troy, MI (US)

(73) Assignee: Kostal of America, Inc., Troy, MI (US)

( * ) Notice: Subject to any disclaimer, the term of this patent is extended or adjusted under 35 U.S.C. 154(b) by 4 days.

(21) Appl. No.: 17/008,905

(22) Filed: Sep. 1, 2020

(65) Prior Publication Data

US 2022/0068174 A1 Mar. 3, 2022

(51) Int. Cl.
*G09G 3/06* (2006.01)
*G09G 3/00* (2006.01)

(52) U.S. Cl.
CPC ..... *G09G 3/006* (2013.01); *G09G 2310/0275* (2013.01); *G09G 2310/08* (2013.01); *G09G 2320/0666* (2013.01); *G09G 2360/10* (2013.01)

(58) Field of Classification Search
CPC ..... G09G 3/006; G09G 2310/0275; G09G 2310/08; G09G 2320/0666; G09G 2360/10; G09G 2330/12
See application file for complete search history.

(56) References Cited

U.S. PATENT DOCUMENTS 7,403,018 B1 * 7/2008 Lo ..... G01R 31/58 324/543
7,414,410 B2 * 8/2008 Pharn ..... G01R 31/11 324/533
7,900,238 B2 * 3/2011 Kwon ..... H04N 21/4424 725/151
2009/0059085 A1 * 3/2009 Yoshioka ..... H04N 5/44 348/E5.133
2010/0301876 A1 * 12/2010 Hartrampf ..... G09G 3/006 324/656
2010/0303097 A1 * 12/2010 Otani ..... G09G 5/006 370/503

FOREIGN PATENT DOCUMENTS

CN 203704981 7/2014

* cited by examiner

*Primary Examiner* — Carolyn R Edwards
(74) *Attorney, Agent, or Firm* — Gunther Evanina; Butzel Long

(57) ABSTRACT

A method of diagnosing connectivity and operational problems between a digital parallel RGB video input device and a digital parallel RGB video display includes transmitting control signals from the input device to the display device, executing the control signals on the display device, generating and transmitting diagnostic signals to a diagnostics processor, and determining if the display is functioning correctly.

14 Claims, 4 Drawing Sheets

METHOD FOR DIAGNOSING DISPLAY CONNECTION AND OPERATION

FIELD OF THE DISCLOSURE

The methods and systems disclosed herein relate to digital parallel RGB video displays, and more particularly to systems and methods for diagnosing video control and data signal failures.

BACKGROUND OF THE DISCLOSURE

Displays are output devices that show static and dynamic video information, driven by an input device such as a computer or embedded system containing a microcontroller. Certain applications, especially safety critical applications, need a method for diagnosing display related problems. These problems could be loss of connections between the display and the input device, or malfunction of the display, showing wrong or incomplete information from the input device.

A digital parallel RGB interface is a type of video display interface in which data and control signals are set digitally from the input device to the display device in parallel fashion (see FIG. 1). The RGB video interface contains signals for the color data red, green, and blue (RGB DATA), as well as control signals for controlling the operation of the display clock (CLK), horizontal synchronization (HSYNC), vertical synchronization (VSYNC), and data enable (DE). These control signals are driven according to the characteristics of the display, particularly display resolution and framerate. The video signals are transmitted over a physical medium—e.g., a cable or wire harness.

SUMMARY OF THE DISCLOSURE

The disclosed systems and methods transmit diagnostic signals from an RGB video display device to a diagnostics processor to evaluate and correct faulty connectivity or operation between a video input device and a video display. For example, video control and data signals executed by the video display can be returned from the display to the video input device and compared with the original control and data signals to determine whether there is a loss of signal. Corrective action can be taken, such as by transmitting a diagnostic signal to a different display, or illuminating a warning light.

DETAILED DESCRIPTION

Figure 1:
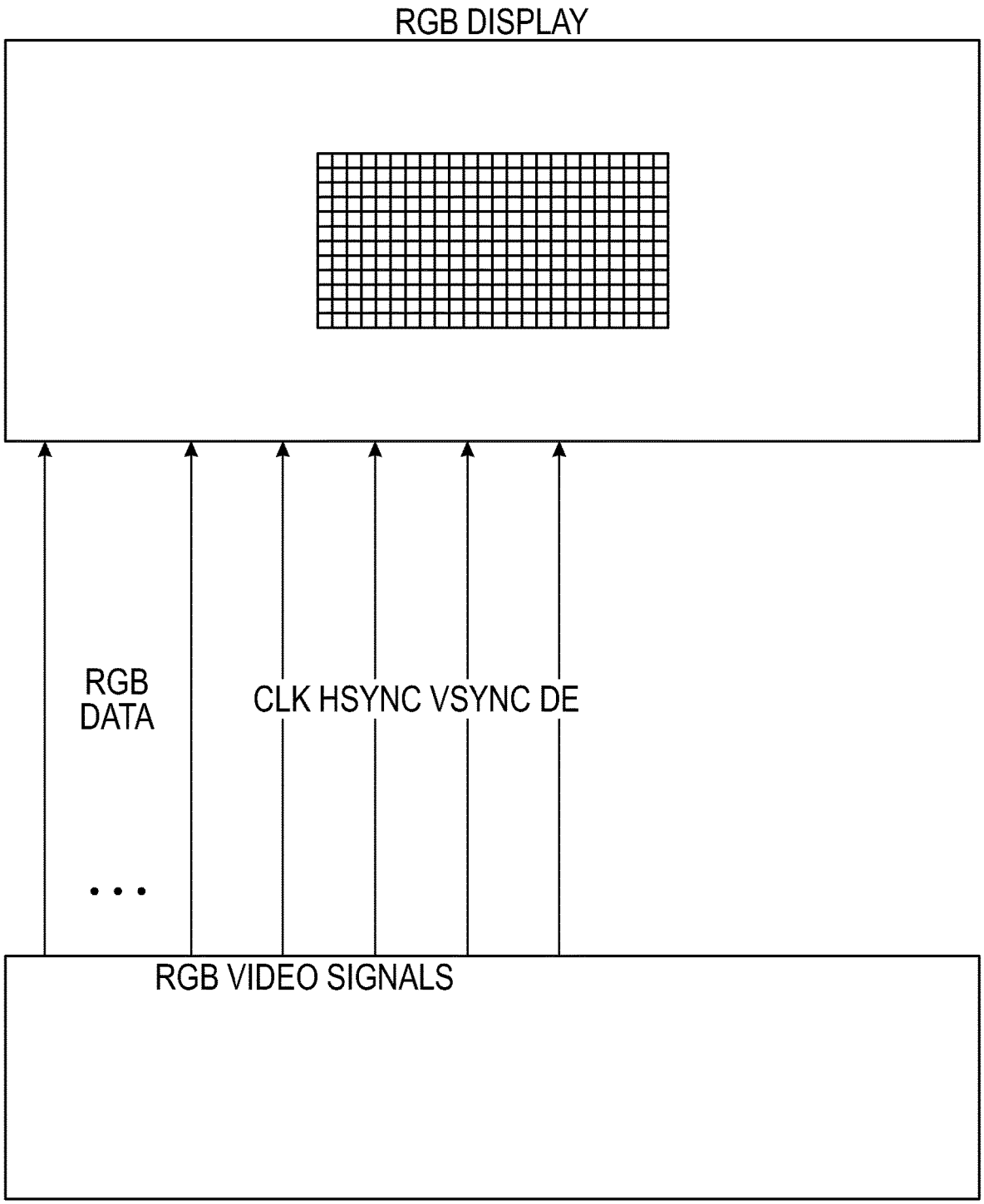
FIG. 1 is a schematic illustration of an input device and RGB display device in which video control signals are transmitted without generating or returning diagnostic signals to analyze connectivity and operation of the display.
Figure 2:
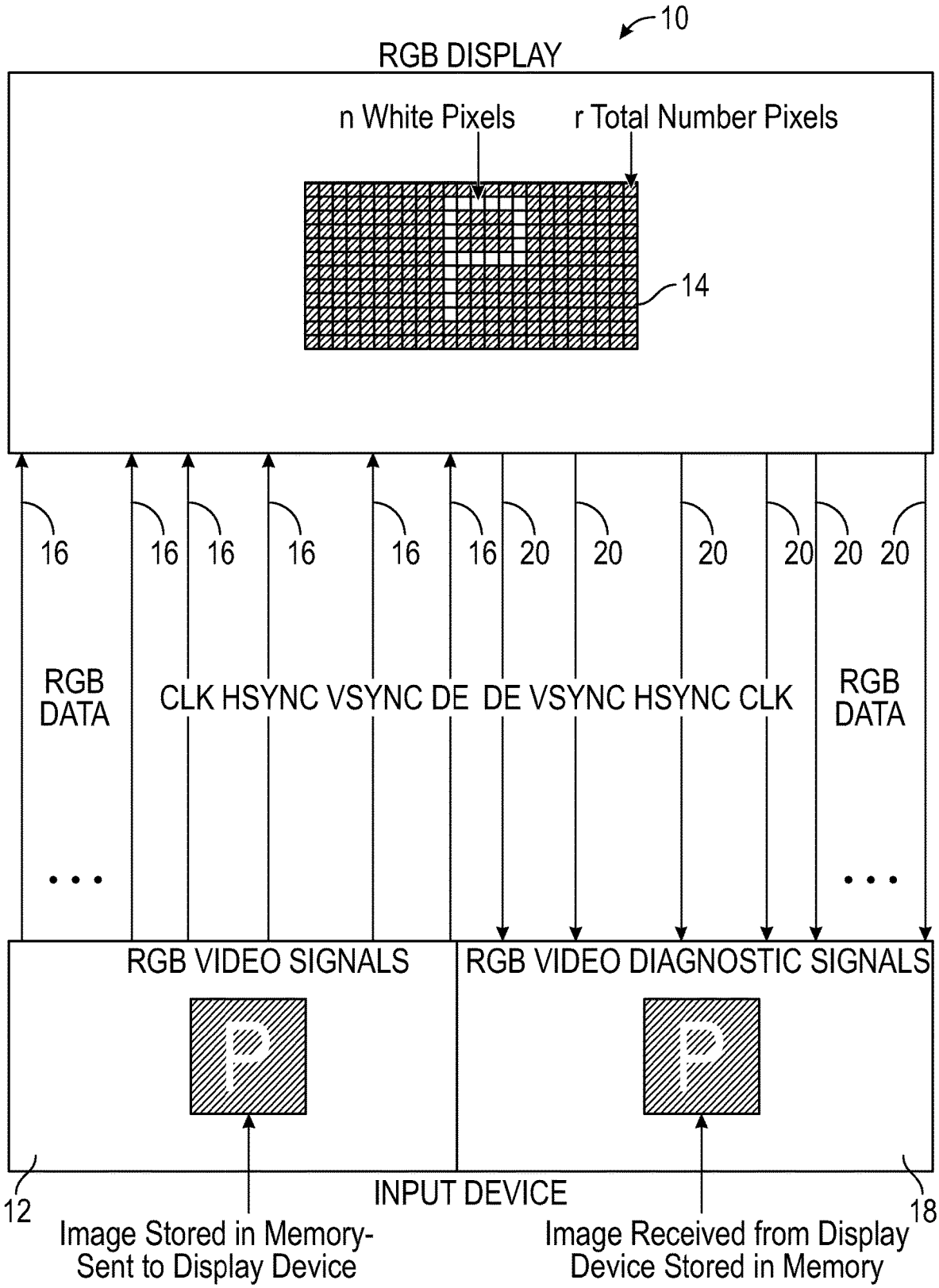
FIG. 2 is a schematic illustration similar to FIG. 1, with diagnostic signals being returned from the display device to the video input device to facilitate analysis of the connectivity between the video input device and display and to evaluate operation of the display.

A method for diagnosing the connection and operation of a digital parallel RGB video display system 10 is presented in FIG. 2. Control signals are transmitted from video input device 12 to display 14 via signal conductors 16. The method involves adding additional diagnostic signals to a connection between the display 14 and the controlling input device 12. The diagnostic signals are transmitted from the display to a diagnostics processor 18 via diagnostic signal conductors 20. The diagnostic signals include a return of the RGB video clock signal back to the input device as well as the horizontal synchronization signal, vertical synchronization signal, display enable signal, and one or more RGB color data signals.

Figure 3:
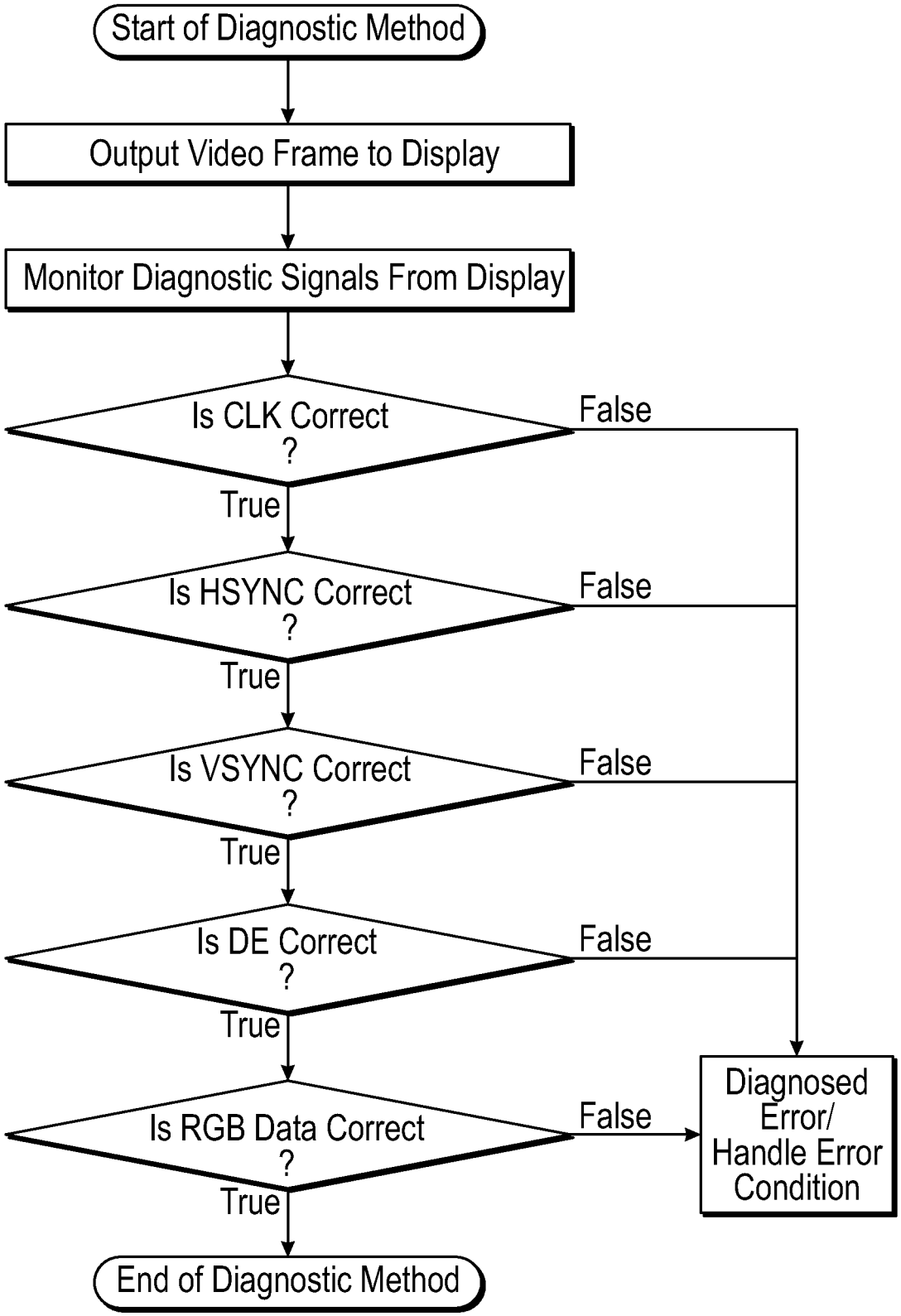
FIG. 3 is a flowchart for a diagnostic method for evaluating connectivity and operation of a digital RGB video display.

At the input device, the diagnostic signals are connected to a microcontroller, which may or may not be the same microcontroller driving the display with the RGB data and control signals. This microcontroller monitors the diagnostic signals for correct operation of the display. Checking of the CLK, HSYNC, VSYNC, DE, and RGB color data is performed on the monitoring microcontroller by software according to the flowchart of FIG. 3. By following this method, any error in the control or data signals may be detected.

As an example a loss of a control signal can be detected by the loss of the corresponding return signal on the diagnostic line. If the RGB video display clock signal (CLK) is absent (due to a disconnected cable or short-circuit), then the microcontroller monitoring the diagnostic lines will detect this loss of signal (CLK is not correct), since the diagnostic clock signal is itself simply the same clock signal returned back to the input device.

Video display malfunction (e.g., wrong display resolution, wrong framerate) may also be detected by the monitoring microcontroller. The clock, horizontal, and vertical synchronization lines may be measured in software by the monitoring microcontroller to ensure correct timing performance. A display driven with the wrong horizontal or vertical display resolution for example, will have the wrong horizontal or vertical synchronization period which would be detected by the monitoring microcontroller as it measures the return diagnostic horizontal or vertical sync signal. A display driven with the wrong framerate will be detected by the monitoring microcontroller due to the wrong number of video clock signal pulses in a given period.

Additionally, routing back one or more of the RGB data lines may also be used as a diagnostic to check the display output, to verify the correct video is being shown. Suppose for example in an automotive application a picture of a vehicle's gear shift position, the letter "P" (for park) is illuminated on the display. Let us say this P is comprised of an all-white color consisting of 24 bits of RGB color data. Each pixel comprising the letter P which would have a binary representation of 111111111111111111111111b binary. Let us say the background is an all-black color consisting of 24 bits of RGB. Each pixel of the background would have a binary representation of 000000000000000000000000b binary.

Let us say the P is being displayed on an RGB video display of arbitrary resolution size and call it r. Let us also say the P is of n pixels in size, that there are n white pixels comprising it.

Because the color line data is routed back to the display input device over the diagnostic interface, when a video frame is output from the input device to the RGB display, the monitoring microcontroller (from FIG. 2) will receive the video frame output. The monitoring microcontroller will then count the number of times the RGB pixel data line was a "1" for each color of the given video frame. This count must exactly equal the number of white pixels in the "P" for the picture output to the video display. If the number counted is different this means that incorrect information is being displayed or the diagnostic line itself has a problem.

This method may be employed using any number of color pixels lines (1 or more), for any RGB video display of any resolution (e.g., 16 bit color, 24 bit color, etc.). The counting of the pixel and the pixel values serves as a checksum to validate that the correct picture is being shown on the RGB video display. Alternatively to counting, the pixel data itself can be read into the microcontroller and the original image reconstructed from the returned pixel data, stored in memory, and compared with the original image (see FIG. 2).

Figure 4:
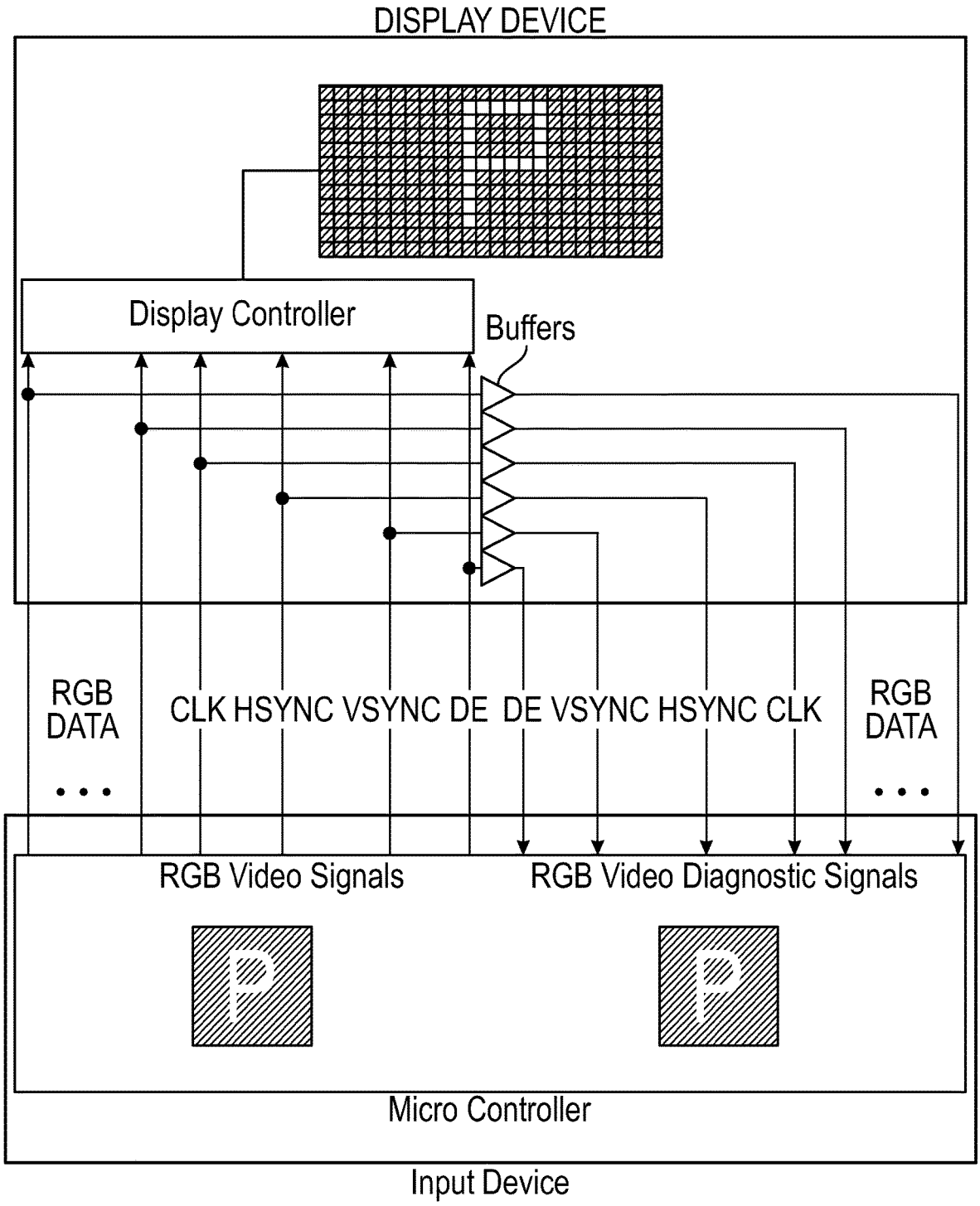
FIG. 4 is a circuit diagram for generating diagnostic RGB video signals.

One method for generating the diagnostic return signals is shown in FIG. 4. In this diagram, the video data and control signals are connected to buffer circuitry such that copies of the signal information can be returned to the input device without affecting the termination impedance of the display signals.

Other display diagnostic solutions do not provide the same level of diagnostic coverage as this method provides. One method involves checking the image stored in memory before it is sent to the display, using a checksum or CRC. It does not fully verify that the image output from the input device actually ended up matching the image stored in memory. Another method for display diagnostic involves monitoring voltage and electrical current supply for the display device. This method however cannot diagnose that the data and control signals sent to the display are correct.

The above description is intended to be illustrative, not restrictive. The scope of the invention should be determined with reference to the appended claims along with the full scope of equivalents. It is anticipated and intended that future developments will occur in the art, and that the disclosed devices, kits and methods will be incorporated into such future embodiments. Thus, the invention is capable of modification and variation and is limited only by the following claims.

What is claimed is:

1. A method for diagnosis connectivity and operation of a digital RGB video display, comprising:

transmitting video control and data signals from a video input device to an RGB video display;

executing the control and data signals on the RGB video display;

generating at the RGB video display a diagnostic signal corresponding to each executed control and data signal;

transmitting the diagnostic signals to a diagnostics processor;

determining using the diagnostic processor whether each of the diagnostic signals is indicative of a correctly executed control or data signal;

taking corrective action when a diagnostic signal indicates that a corresponding video control or data signal was not received or not properly executed by the RGB video display;

wherein the video control and data signals include red, green, blue color data signals, a clock control signal, a horizontal synchronization control signal, a vertical synchronization control signal, and a data enable control signal, wherein one or more RGB data lines is used as a diagnostic signal to check display output, and wherein the diagnostics processor counts the number of ones in a binary data line of a received diagnostic data signal and determines whether the count is exactly equal to the number of ones in a corresponding binary data line of the data signal sent to the display.

2. The method of claim 1, wherein a loss of a control signal results in a loss of the corresponding diagnostic signal.

3. The method of claim 1, wherein the diagnostic clock signal is the same as the clock signal.

4. The method of claim 1, wherein pixel data from the video display is read into the diagnostics processor to generate a return data image that is compared with an original image stored in the video input device.

5. The method of claim 1, wherein the video control signals are connected to buffer circuitry to facilitate generation and transmission of diagnostic signals to the diagnostics processor without affecting termination impedance of the display signals.

6. The method of claim 1, wherein the diagnostics processor and the video input device are the same device.

7. The method of claim 1, wherein the diagnostics processor and video input device are separate devices.

8. An RGB video display system having connectivity and operational diagnostic capabilities, comprising:

a video input device configured to transmit RGB video control and data signals;

an RGB video display adapted to receive and execute video control and data signals;

signal conductors for transmitting video control signals from the video input device to the video display;

a diagnostics processor;

signal conductors for transmitting diagnostics signals from the RGB video display to diagnostics processor;

wherein the diagnostics processor is configured to determine whether each of the diagnostic signals is indicative of a correctly executed video control or data signal;

wherein the video control and data signals include red, green, blue color data signals, a clock control signal, a horizontal synchronization control signal, a vertical synchronization control signal, and a data enable control signal;

wherein one or more RGB data lines is used as a diagnostic signal to check display output; and wherein the diagnostics processor counts the number of ones in a binary data line of a diagnostic received signal and determines whether the count is exactly equal to the number of ones in a corresponding binary data line of the data signal sent to the display.

9. The system of claim 8, wherein a loss of a control signal results in a loss of the corresponding diagnostic signal.

10. The system of claim 8, wherein the diagnostic clock signal is the same as the clock signal.

11. The system of claim 8, wherein pixel data from the video display is read into the diagnostics processor to generate a return data image that is compared with an original image stored in the video input device.

12. The system of claim 8, wherein the video control signals are connected to buffer circuitry to facilitate generation and transmission of diagnostic signals to the diagnostics processor without affecting termination impedance of the display signals.

13. The system of claim 8, wherein the diagnostics processor and the video input device are the same device.

14. The system of claim 8, wherein the diagnostics processor and video input device are separate devices.

* * * * *